United States Patent [19]

Yan

[11] Patent Number: 4,529,408

[45] Date of Patent: Jul. 16, 1985

[54] PUMPABLE SOLID FUELS FOR SMALL FURNACE

[75] Inventor: Tsoung-Yuan Yan, Philadelphia, Pa.

[73] Assignee: Mobil Oil Corporation, New York, N.Y.

[21] Appl. No.: 460,337

[22] Filed: Jan. 24, 1983

[51] Int. Cl.[3] ..... C10L 1/32

[52] U.S. Cl. ..... 44/51; 44/53; 44/67

[58] Field of Search ..... 44/51, 53, 56, 67, 62, 44/76, 57, 4; 252/352, 353

[56] References Cited

U.S. PATENT DOCUMENTS 4,210,423 7/1980 Yan ..... 44/1 C
4,282,006 8/1981 Funk ..... 44/51

FOREIGN PATENT DOCUMENTS 845051 6/1970 Canada ..... 44/51

*Primary Examiner*—William R. Dixon, Jr.
*Assistant Examiner*—Margaret B. Medley
*Attorney, Agent, or Firm*—Alexander J. McKillop; Michael J. Gilman; Malcolm D. Keen

[57] ABSTRACT

A method is described for preparing a solid fuel in the form of a coal/liquid slurry for use in small furnaces. The fuel has a relatively uniform heating value of 10,000 to 14,000 Btu per pound and is prepared by crushing and grinding coal to less than 200 mesh, blending the coal fines with additives for $SO_x$ abatement, for ignition and oxidation promotion, and ash modifiers to improve the combustion quality of the fuel. The blended coal mixture is wetted with water and then slurried with oil, water or alcohol to form a thick slurry. The thick slurry is stabilized by proper selective of surfactants, polymers and other additives by way of interparticle bonding or bridging to provide a pumpable solid fuel that is stable in storage.

11 Claims, No Drawings

PUMPABLE SOLID FUELS FOR SMALL FURNACE

BACKGROUND OF THE INVENTION

1. Field of the Invention

This invention relates to a method for producing a pumpable solid fuel for small furnaces in the form of a coal/liquid slurry containing various additives to improve its ignition, minimize $SO_x$ emmision, and control its flow properties in finely divided form.

2. Review of the Prior Art

At the present time, petroleum imports account for more than 40% of United States usage. At any time, this supply could be curtailed or eliminated by political or military action. Even if such an emergency situation does not develop, liquid hydrocarbon fuels could become increasingly scarce in view of government policies that affect domestic exploration, development, and refining. As such scarcity develops, stationary furnaces and power plants, including domestic and commercial furnaces for space heating and hot water, will tend to be fueled with solid fuels, particularly coals and other bio-mass such as wood products.

As the gaseous and liquid fuels become more and more scarce in the future, solid fuels, principally coal, will have to be used more and more extensively. Coal already is playing an ever increasing role in fueling power plants. However, it is much more difficult to use coal in small furnaces. The problems include handling, transporting, burning and emissions, particularly $SO_x$. To facilitate the use of coal in small furnaces U.S. Pat. No. 4,210,423 discloses a method for preparing solid fuel in either powder or briquette form. Copending application to Yan et al., Ser. No. 413,572, filed Aug. 31, 1982, discloses a method for producing an improved coal/water slurry by contacting run-of-mined coal with a mixture of an alkali and an organic solvent, pulverizing the treated coal to a predetermined particle size and slurrying the pulverized coal with water to form a pumpable, coal/water slurry having improved burning quality and $SO_x$ abatement and is stable in storage.

From the viewpoint of handling coal for small furnaces, the solid fuel in a pumpable form would be preferred. The present invention enables coal to be formulated in a stable, pumpable form. The formulated fuel also contains additives for $SO_x$ abatement, for ignition and oxidation promotion, and ash modifiers to improve the combustion quality of the fuel.

SUMMARY OF THE INVENTION

The present invention relates to a method for producing a pumpable solid fuel for small furnaces which contains coal in a finely divided particulate form, is easily pumped though a pipeline, is stable in storage, and has improved combustion quality. In accordance with the invention, coal or blends thereof having a heating value of about 12,000 to 14,000 Btu per pound are pulverized to a fine size below 200 mesh. One or more of the following additives having approximately the same particle distribution and average particle size as the coal blend are added and the ingredients mixed:

(1) an $So_2$ scavenger for minimizing the effects of sulfur in said coal selected from the group consisting of limestone, lime, dolomite, gypsum, calcium phosphonate, bauxite, and mixtures;

(2) a combustion improver and ash modifier for imparting burning properties and for reducing corrosion, fouling, and ash slagging, selected from the group consisting of manganese dioxide, iron oxide, and manganese nodules.

(3) an ignition and combustion promoter selected from the group consisting of alcohols, kerosenes, light diesel oil, and light hydrocarbons.

Thereafter, sufficient water is added to the blended mixture in an amount sufficient to wet the mixture. The resulting wetted mixture is slurried with oil, water, alcohol or mixtures thereof containing a surfactant or polymer in an amount sufficient to stabilize the slurry so as to prevent the subsidence and compaction of the coal particles thereby enabling the slurry to be transported and stored for extended periods of time and remain pumpable. The viscosity of the coal/liquid slurry is within the range of 500 to 10,000 cp and the coal concentration is about 10 to 70 percent by weight of liquid.

DESCRIPTION OF THE PREFERRED EMBODIMENT

The invention relates to a method for producing a pumpable solid fuel for small furnaces which contains coal in finely divided particulate form, is easily pumped through a pipeline, is stable in storage, and has improved combustion quality.

The pumpable solid coal fuel in the form of a coal/liquid slurry can be prepared from all kinds of coal or blend of coals, although coals with a high heating value, low sulfur, or a high volatile A bituminous coal are clearly preferred. It should be understood that the term "coal" refers to any type of solid carbonaceous fuel, such as anthracite coal, bituminous coal, sub-bituminous coal, lignite, peat, coke, petroleum coke, and the like. It should also be understood that the sulfur in coal occurs in three forms: (1) pyritic sulfur in the form of pyrite or marcasite, (2) organic sulfur, and (3) sulfate sulfur.

The first step in preparing the coal/liquid slurry according to the present invention is to grind a coal or mixture of coal having a heating value of about 10,000 to 14,000 Btu/lb to a fineness below 200 mesh. The grinding can be done by ball mills or other types of conventional apparatus may be employed for pulverizing coarse coal in the preparation of the finely divided coal or by chemical comminution. The crushing and grinding of the coal can be accomplished either in a dry state or in the presence of a liquid such as water, if desired. Upon size reduction, some ash material can be liberated and the coal can be optionally beneficiated by washing, magnetic separation, flotation and the like. During or after the course of the size reduction, the coal surface can be conditioned to facilitate subsequent stabilization. For instance, this involves exposure of the coal to air to make the surface more polar and more hydrophilic. Obviously, this treatment is adjusted depending on the nature of the liquid phase of the slurry and the contemplated mechanism of stabilization.

The ground coal is then blended with at least one of the following soluted additives, ground to approximately the same size as the coals:

(1) an $SO_2$ scavenger, selected from the group consisting of limestone, lime dolomite, gypsum, calcium phosphate in the form of phosphate rock, apatite or phosphorite, bauxite, and mixtures thereof. The amount of scavenger employed ranges from 0.5 to 5 wt. % and will vary with the sulfur content of the particular coal. For coal having a sulfur content of about 2 wt. % or less about 0.5 to 2 wt. % of a scavenger, preferably dolomite, can be used. The amount of scavenger can be quite low since the indigenous ash retains much of the sulfur compounds, thereby preventing their emission to the air. Complete reaction with sulfur is not therefore required to meet the EPA emission standard of 80 micrograms of sulfur dioxide per cubic meter of air. Dolomite is the preferred scavenger and is employed in amounts ranging per 10 to 40 pounds per ton of coal.

(2) a combustion improver and ash modifier for reducing corrosion, fouling and ash slagging, selected from the group consisting of manganese dioxide, iron oxide, manganese nodules, sand and mixtures thereof. The amount of combustion improver employed will range from about 0.1 to 5 pounds, preferably 0.1 to 1.5 pounds, per ton of coal. Iron oxide is preferably in the form of bog iron, limonite, hemantite, magnetite or siderite.

(3) an ignition and combustion promoter to reduce or eliminate the need for auxiliary liquid fuel selected from the group consisting of alcohols, kerosene, light desiel oil, and light hydrocarbons, particularly aromatics.

In a preferred embodiment, manganese nodules are used as the combustion improver. These nodules, as is known, are naturally occurring deposits of manganese, along with other metals, including iron, cobalt, nickel, and copper, found on the floor of bodies of water. They are found in abundance on the floors of oceans and lakes. For example, they are found in abundance on the floor of the Atlantic and Pacific Oceans and on the floor of Lake Michigan. The nodules are characterized by a large surface area, i.e., in excess of 150 square meters per gram. The nodules have a wide variety of shapes but most often those from the oceans look like potatoes. Those from the floor of bodies of fresh water, such as the floor of Lake Michigan, are smaller in size. Their color varies from earthy black to brown depending upon their relative manganese and iron content. The nodules are porous and light, having an average specific gravity of about 2.4. Generally, they range from $\frac{1}{8}$ to 9 inches in diameter but may extend up to considerably larger sizes approximating 4 feet in length and 3 feet in diameter and weighing as much as 1700 pounds. In addition to the metals mentioned above, the nodules contain silicon, aluminum, calcium and magnesium, and small amounts of molybdenum, zinc, lead, vanadium, and rare earth metals.

Thereafter, water is added to the blended mixture of coal and additives in an amount sufficient to wet the mixture. The resulting mixture is then slurried with a liquid such as oil, water, alcohol or mixtures thereof to form a coal/liquid slurry. To conserve liquid fuel, water is the preferred liquid medium. In order to form a thick slurry, the concentration of coal is about 10 to 70 percent by weight of liquid (i.e. one hundred pounds of slurry contains frm about 10 to 70 pounds of finely divided coal.) To stabilize the slurry, i.e. to prevent the subsidence and compaction of the coal particles so that the slurry can be transmitted and stored for extended period of time and remain pumpable, the liquid medium contains surfactants and polymers in a amount required to make the proper consistency of the final slurry. Suitable surfactants include anionic or cationic surfactants, and preferably non-ionic or ampholytics surfactants. Suitable non-ionic surfactants containing oxyalkylene groups are described in U.S. Pat. Nos. 3,048,548; 3,442,242; 3,314,891; 3,595,968; 3,933,670 and the like. The surfactant can be employed effectively in a quantity of 0.005 to 1 weight percent based on the total weight of the coal composition. Useful polymers include polyacrylamides, methyl celluloses, Xanthan gum (polysaccharide) and others. The surfactants and polymer stabilize the slurry by way of interparticle bonding or bridging. The final mixture is mixed well to form a homogeneous thick slurry which is stable for storage, yet pumpable. The viscosity of the coal/liquid slurry is within the range of 500 to 10,000 cp.

The viscosity of the slurry can be controlled by addition of water, alcohols and electrolytes to decrease viscosity, and thickeners such as Xanthan gum to increase viscosity. The viscosity of the slurry should be kept low to facilitate pumping but should be kept high enough to assure storage stability. A compromise between these two conflicting requirements has to be made.

To facilitate pumping of the thick slurry fuel prepared according to the present invention, specidal equipment can be used. For instance, the storage tank can be conical, and a slurry pump such as a Moyno pump can be directly connected at the bottom of the cone to eliminate any standing pipe to avoid packing and plugging.

Obviously, many other variations and modification of the invention as hereinbefore set forth may be made without departing from the spirit and scope therefore only such limitations should be imposed as are indicated in the appended claims.

What is claimed is:

1. A method for producing a pumpable solid fuel for small furnaces which contains coal in a finely divided particulate form, is easily pumped through a pipeline, is stable in storage, and has improved combustion quality, comprising the following steps:

(a) grinding a coal or mixture of coals having a heating value of about 10,000 to 14,000 Btu per pound to a fineness below 200 mesh.;

(b) blending the coal or coals with an additive combination consisting essentially of at least one additive selected from each group set forth below:

(1) an $SO_2$ scavenger for minimizing the effects of sulfur in said coal selected from the group consisting of limestone, lime, dolomite, and mixtures thereof;

(2) a combustion improver and ash modifier for imparting burning properties and for reducing corrosion, fouling, and ash slagging, comprising manganese nodules.

(3) an ignition and combustion promoter selected from the group consisting of alcohols, and light hydrocarbons; the solid additives having approximately the same particle size distribution and average particle size as the coal;

(c) adding sufficient water to the blended mixtures to wet the mixture; and (d) slurrying said wetted mixture with water containing a surfactant or polymer in an amount sufficient to stabilize the slurry so as to prevent the subsidence and compaction of the coal particles thereby enabling the slurry to be transported and stored for extended periods of time and remain pumpable.

2. The method of claim 1 wherein the surfactant is selected from the group consisting of anionics, cationics, non-ionics, and ampholytics.

3. The method of claim 1 wherein the polymer is selected from the group consisting of polyacrylamides, methyl celluloses, and Xanthan gum (polysaccharide).

4. The method of claim 1 wherein the viscosity of the slurry prepared according to step (d) is controlled by the addition of a dissolved viscosity-increasing additive or a dissolved viscosity-decreasing additive.

5. The method of claim 4 wherein the viscosity-decreasing additive is water, alcohols, or electrolytes.

6. The method of claim 4 wherein the viscosity-increasing additive is Xanthan gum (polysaccharide) or a water-soluble partially hydrolyzed acrylamide polymer.

7. The method of claim 1 wherein the viscosity of the slurry is controlled within the range of 500 to 10,000 cp.

8. The method of claim 1 wherein said coal fines make up from about 30% to 90% by total weight of said slurry.

9. The method of claim 1 further comprising after the size reduction step (a) beneficiating the fine coal by washing, magnetic separation, or flotation to remove additional mineral matter.

10. The method of claim 1 further comprising after the size reduction step (a) treating the fine coal with air to make the surface of the coal more hydrophilic so as to facilitate subsequent stabilization.

11. The method of claim 1 wherein the amount of surfactant employed is about 0.005 to 1 weight percent based on the total weight of the coal composition.

* * * * *